US005617812A

United States Patent [19]

Balderson et al.

[11] Patent Number: 5,617,812

[45] Date of Patent: Apr. 8, 1997

[54] TAMPER EVIDENT SYSTEM

[75] Inventors: Simon N. Balderson, Telford; Robert J. Whitwood, Stafford, both of United Kingdom

[73] Assignee: Sealed Air (NZ) Limited, New Zealand

[21] Appl. No.: 683,115

[22] Filed: Jul. 16, 1996

Related U.S. Application Data

[63] Continuation of Ser. No. 241,800, May 12, 1994, abandoned.

[30] Foreign Application Priority Data

May 18, 1993 [GB] United Kingdom ..... 9310202

[51] Int. Cl.[6] ..... G01N 21/78

[52] U.S. Cl. ..... 116/206; 206/459.1; 206/807; 215/230

[58] Field of Search ..... 116/200, 206; 206/807, 459.1; 215/230; 220/DIG. 34

[56] References Cited

U.S. PATENT DOCUMENTS

| | | | |
|---|---|---|---|
| 2,040,798 | 5/1936 | Schoonmaker | 215/230 |
| 3,663,176 | 5/1972 | Cagle et al. | 436/116 |
| 3,800,780 | 4/1974 | Elliot . | |
| 3,899,295 | 8/1975 | Halpern | 116/206 X |
| 4,349,509 | 9/1982 | Yoshikawa et al. . | |
| 4,411,918 | 10/1983 | Cimino et al. | 426/124 |
| 4,411,987 | 10/1983 | Kobayashi et al. | 430/542 |
| 4,505,399 | 3/1985 | Weiner | 215/230 |
| 4,511,052 | 4/1985 | Klein et al. | 215/230 |
| 4,526,752 | 7/1985 | Perlman et al. | 116/207 X |
| 4,627,336 | 12/1986 | Nam | 99/467 |
| 5,096,813 | 3/1992 | Krumhar et al. | 435/28 |
| 5,358,876 | 10/1994 | Inoue et al. | 436/136 |

FOREIGN PATENT DOCUMENTS

| | | |
|---|---|---|
| 0326464 | 8/1989 | European Pat. Off. . |
| 0513364 | 11/1992 | European Pat. Off. . |
| 2506266 | 11/1982 | France . |
| WO91/05252 | 4/1991 | WIPO . |
| WO92/12068 | 7/1992 | WIPO . |

*Primary Examiner*—William A. Cuchlinski, Jr.
*Assistant Examiner*—Willie Morris Worth
*Attorney, Agent, or Firm*—Bell, Seltzer, Park & Gibson, P.A.

[57] ABSTRACT

A tamper evident system for indicating when a closed enclosure (24) has been opened comprises a window (21) and a sensor (22) colour sensitive to presence of a gas. The sensor (22) is located in the enclosure (24) so as to be visible through the window (21). Any compositional change of gas in the enclosure (24) is signalled by a change of colour of the sensor (22).

19 Claims, 3 Drawing Sheets

TAMPER EVIDENT SYSTEM

This application is a continuation of application Ser. No. 08/241,800, filed May 12, 1994 now abandoned.

BACKGROUND OF THE INVENTION

This invention relates to a tamper evident system and, more particularly, to a tamper evident system for indicating when a closed enclosure has been opened.

SUMMARY OF THE INVENTION

The invention is characterised in that the enclosure is provided with a see-through membrane and indicating means colour sensitive to presence or absence of a gas, the indicating means being located adjacent the membrane so that opening of the enclosure causes compositional change of gas in the enclosure which is signalled by a change of colour of the indicating means visible through the membrane from outside of the enclosure.

The gas composition within the enclosure is arranged to be different from air so that opening of the enclosure causes the gas composition within the enclosure to become similar to that of air which is signalled by change of colour of the indicating means.

Following is a description, by way of example only and with reference to the accompanying drawings, of one method of carrying the invention into effect.

DETAILED DESCRIPTION OF THE INVENTION

Figure 1:
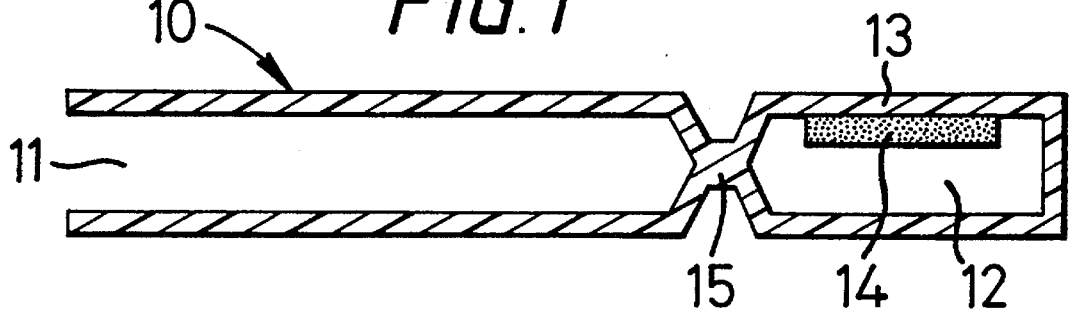
FIG. 1 is a diagrammatic cross section of an open flexible container including one embodiment of a tamper evident system in accordance with the present invention.
Figure 2:
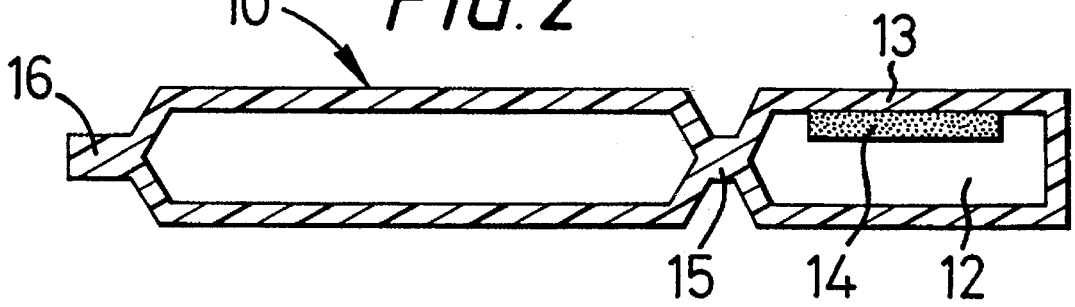
FIG. 2 is a view similar to FIG. 1 showing the container in a closed condition.

Referring now to FIGS. 1 to 4 of the drawings, there is shown a flexible container 10 having an opening 11 and a compartment 12 located at a base of the container 10 remote from the opening 11. The compartment 12 comprises a "see-through" wall 13. The wall 13 carries on an inner surface thereof a sensor 14 which changes colour to signal compositional change of gas. The compartment 12 contains carbon dioxide or a gas the main constituent of which is carbon dioxide. The compartment 12 is separated from the container 10 by means of a breakable membrane 15.

Figure 3:
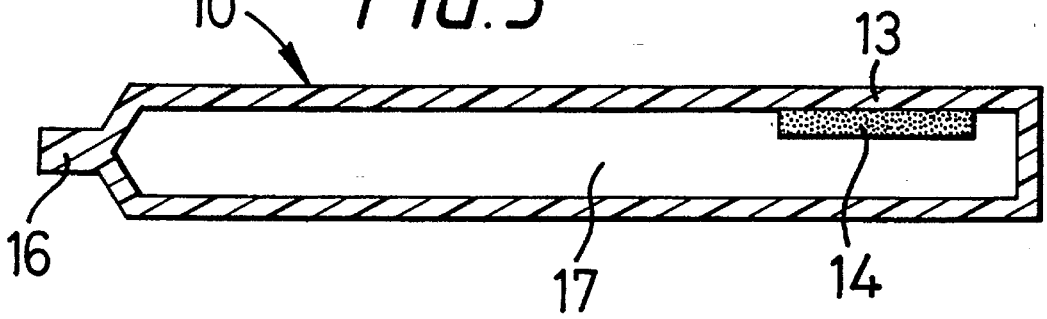
FIG. 3 is a view similar to FIGS. 1 and 2 in which a membrane of the container has been fractured.

After contents have been inserted into the container 10, the container is closed and the Opening is sealed, as shown at 16. The compartment 12 is then squeezed such that pressure inside the compartment 12 is increased to the extent that the membrane 15 is fractured, as shown in FIG. 3, thereby forming an enclosure 17. The gases which were contained in the container 10 and in the compartment 12, in consequence, mix one with another in the enclosure 17. However, the sensor 14 is selected such that no colour change results from the compositional change of the gases contained in the enclosure 17.

Figure 4:
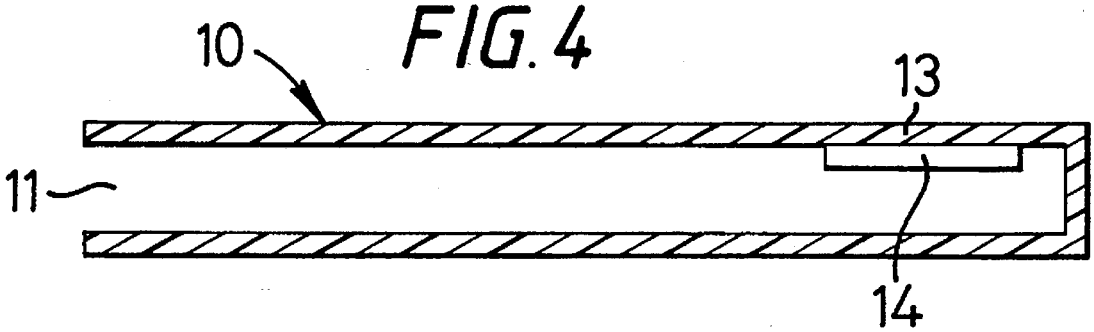
FIG. 4 is a view similar to FIGS. 1 to 3 showing the container after having been opened from the closed condition shown in FIG. 3.
Figure 5:
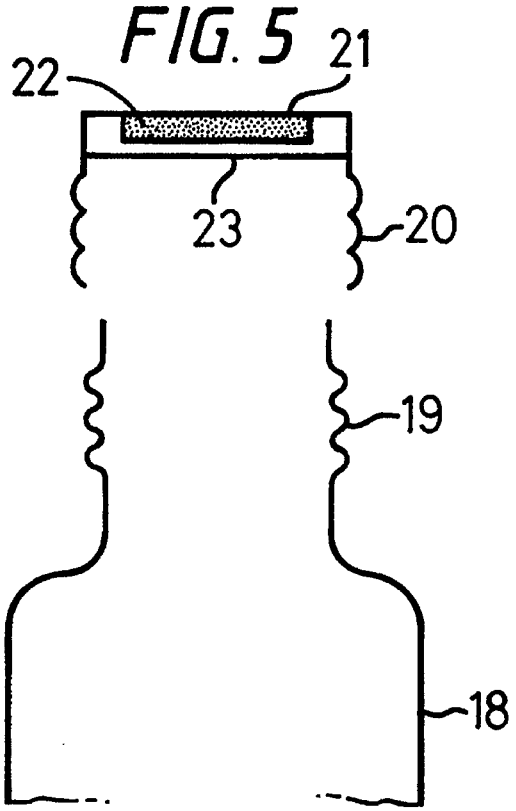
FIG. 5 is a diagrammatic representation of a container and cooperating cap, the cap incorporating another embodiment of a tamper evident system in accordance with the present invention and shown separate from the container.

The arrangement is such that, when the container 10 is reopened, as shown in FIG. 4, and the carbon dioxide is released, the subsequent compositional change is signalled by the sensor 14 which changes colour as a result of the change in gas composition in the open container 10. The colour of the sensor 14 is not reversed thereby indicating that the container 10 has been opened subsequent to having been sealed.

It will be appreciated that the sensor 14 will be of such composition that colour change will not be reversible by blowing into the container 10 prior to resealing.

Referring now to FIGS. 5 to 8 of the drawings, there is shown a bottle 18 having an externally threaded neck 19 and an internally threaded cap 20 for cooperating with the neck 19 to close the bottle 18.

The cap 20 is provided with a window 21 on an inner surface of which is coated a sensor 22 of oxygen sensitive material. Preferably, the material is colloidal copper which is very finely divided copper having a red colour which becomes colourless when exposed to oxygen. The sensor 22 is encapsulated between the window 21 and a fracturable membrane 23.

Figure 6:
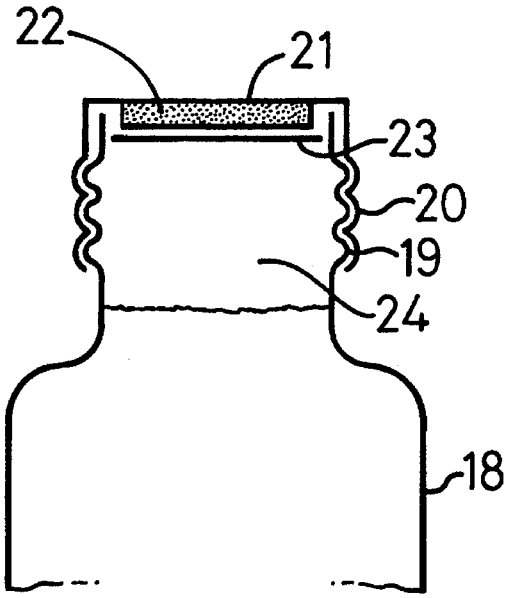
FIG. 6 is a view similar to FIG. 5 showing the container and the cap being applied to the container to close the container.
Figure 7:
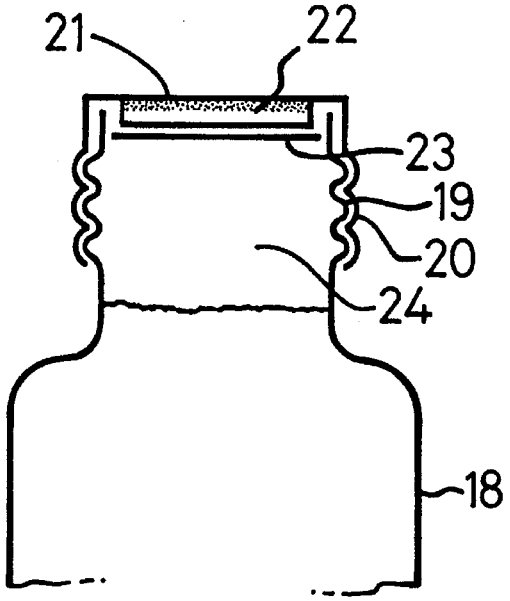
FIG. 7 is a view similar to FIGS. 5 and 6 showing the container when closed by the cap.
Figure 8:
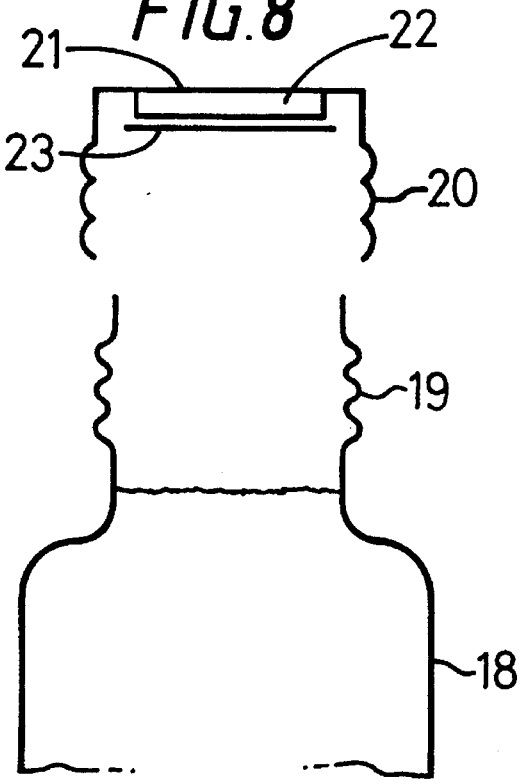
FIG. 8 is a view similar to FIGS. 5 to 7 showing the container and the cap removed therefrom.

The arrangement is such that, after the bottle 18 receives contents, the cap 20 is screwed onto the neck 19. As the cap 20 is screwed downwardly of the neck 19 the membrane 23 is fractured by the upper rim of the neck 19, as shown in FIG. 6 so that the sensor 22 is exposed to an atmosphere contained in an enclosure 24 formed above the contents in the bottle 18 by closure of the neck 19 of the bottle 18 by the cap 20.

However, the thickness of the material comprising the sensor 22 is arranged such that oxidation reaction will take place on a lower surface of the material and will gradually move through the material and any oxygen contained within the enclosure 24 between the Contents and the sensor 22 is of insufficient concentration to effect colour change of the sensor 22.

Nevertheless, the sensor 22 is exposed to the small amount of air above the contents in the bottle 18 and, as a result, it absorbs or "scavenges" the oxygen from the air.

In consequence, the atmosphere above the contents of the bottle 18 is oxygen free. The contents thus will not be impaired by oxidation and will have a longer storage life than would be the situation if the oxygen were present.

As a result of this reaction, some of the material of the sensor 22 will have lost its colour. However, if the quantity of material is selected carefully, there will still be enough unaffected material left to ensure that the colour is seen through the window 21 of the cap 20.

When the cap 20 is unscrewed from the neck 19 of the bottle 18 so that the contents of the bottle 18 may be removed, the remaining coloured material of the sensor 22 is exposed to atmospheric oxygen and will lose its remaining colour, thereby providing an immediate indication that the bottle 18 has been opened. The colour change remains even if the cap 20 is screwed back onto the neck 19 of the bottle 18.

Figure 9:
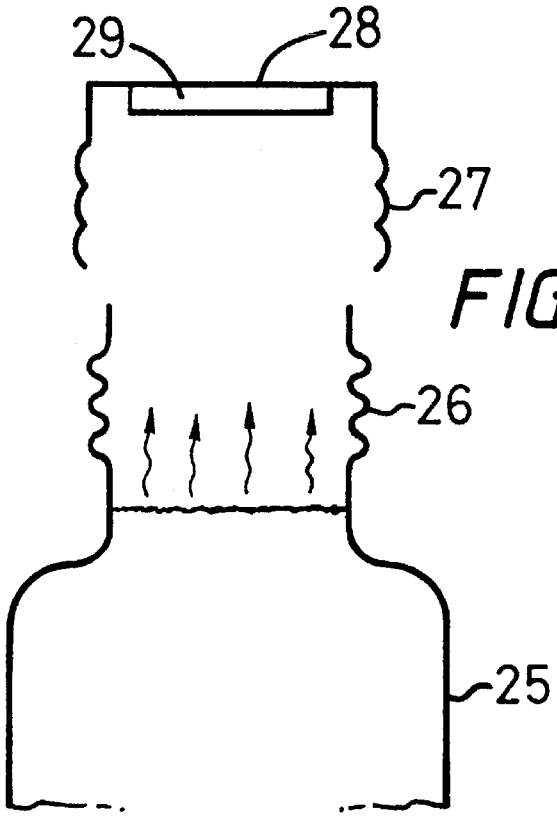
FIG. 9 is a diagrammatic representation of a container and cooperating cap, the cap incorporating a further embodiment of a tamper evident system in accordance with the present invention and shown separate from the container.
Figure 10:
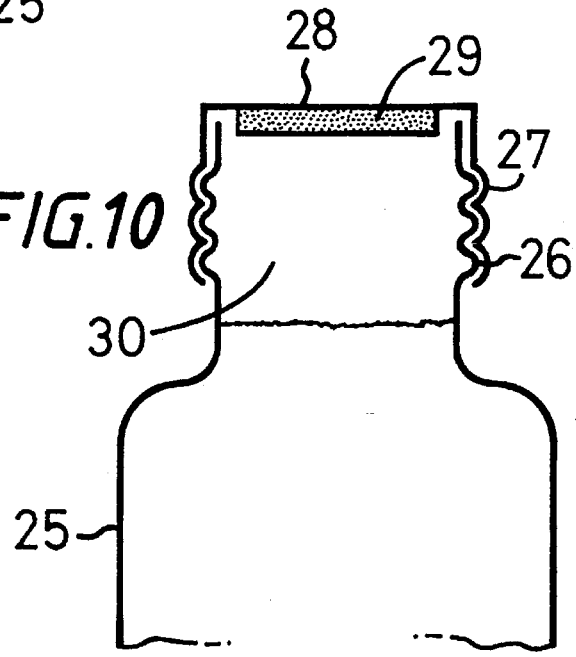
FIG. 10 is a view similar to FIG. 9 showing the container and the cap being applied to the container to close the container.
Figure 11:
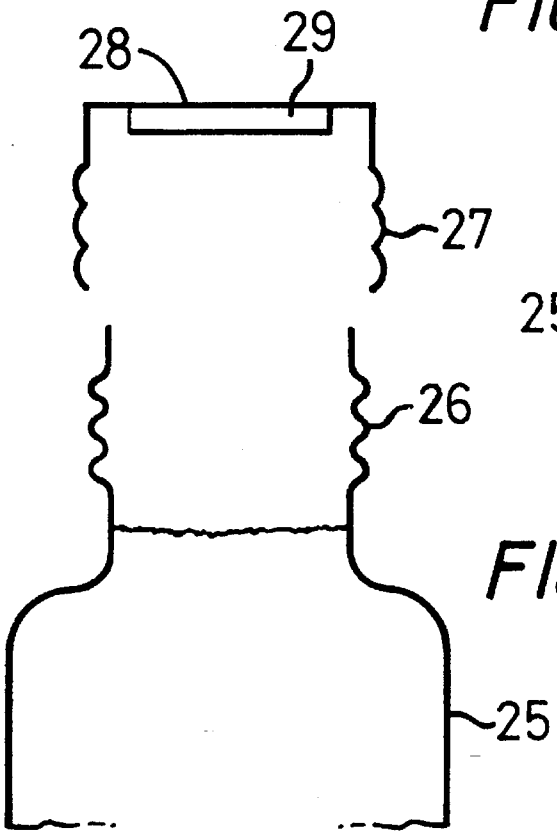
FIG. 11 is a view similar to FIGS. 9 and 10 showing the container and the cap removed therefrom.

Referring now to FIGS. 9 to 11 of the drawings, there is shown a bottle 25 having an externaly threaded neck 26 and an internally threaded cap 27 for cooperating with the neck 26 to close the bottle 25.

The cap 27 is provided with a window 28 on an inner surface of which is coated a sensor 29 of oxygen sensitive material which changes colour reversibly in accordance with a proportion of oxygen contained in an atmosphere surrounding the sensor 29.

The arrangement is such that, after preheated contents are inserted in the bottle 25, the bottle is closed by the cap and, as the contents cool, a partial vacuum develops in an enclosure 30 formed above the contents in the bottle 25 by closure of the neck 26 of the bottle 25 by the cap 27. The low oxygen content in the enclosure 30 will be indicated by a change of colour of the sensor 29 visible through the window 28.

When the cap 27 is removed from the neck 26 of the bottle 25, the sensor 29 is exposed to atmospheric oxygen and will change colour indicating that the bottle 25 has been opened. Subsequent reapplication of the cap 27 to the neck 26 of the bottle 25 will not cause any further colour change in the sensor 29 because the enclosed space between the contents and the sensor 29 will now contain air.

It will be appreciated that material sensitive to a gas other than oxygen may be provided in accordance with the present invention. For example, a material which changes in colour according to a proportion of carbon dioxide present in an atmosphere surrounding the material may be provided. Such a meterial is disclosed in WO 91/05252. With such an arrangement, carbon dioxide would be supplied to a container in either a solid or gaseous state before effecting closure of the container and would thereafter be contained in an enclosed space between contents in the container and the gas sensitive material. The material would be of a colour indicative of presence of the proportion of carbon dioxide present in the atmosphere in the enclosed space. When the container subsequently is opened, the carbon dioxide will disperse from the previously enclosed space and will be replaced by air resulting in a colour change of the material indicating that the container has been opened.

It will also be appreciated that other arrangements may be provided for effecting change in the gas composition of a container. For example, reactive components may be held in blisters or micro-capsules and the membranes of the blisters or micro-capsules may be fractured to effect compositional change. An example of other reactive components is sodium hydrogen carbonate and acetic acid which react to release carbon dioxide. Change in the gas composition of a container may also be effected by scavenging a gas in the container. This may be achieved by exposing a reactive material to gases in the container.

We claim:

1. A tamper evident system for a closed enclosure for indicating when the closed enclosure has been opened, said tamper evident system comprising (a) a see-through membrane provided in the enclosure, (b) a fracturable wall separating the enclosure into first and second compartments, said first compartment containing at least one first gas, said second compartment containing at least one second gas, said fracturable wall being adapted to be fractured to allow said first and second gases to mix and form a composition of gases in the closed enclosure, the composition of gases being changed upon opening of the enclosure, and indicating means located in the enclosure adjacent said see-through membrane and visible from the exterior of the enclosure, said indicating means being sensitive to a change in the composition of gases in the enclosure caused by the opening of the enclosure for giving a visual indication of the change in the composition of gases and thus of the opening of the enclosure.

2. The system of claim 1, wherein the composition of gases in the enclosure is different from that of air.

3. The system of claim 2, wherein the composition of gases in the enclosure is further provided by exposure to the indicating means, which scavenges one or more gases in the enclosure.

4. The system of claim 2, wherein the composition of gases in the enclosure is further provided by reacting reactive components one with another.

5. The system of claim 2, wherein the composition of gases in the enclosure is further provided by addition of a gas to one of the compartments before the enclosure is closed.

6. The system of claim 5, wherein the gas which is added is carbon dioxide.

7. The system of claim 3, wherein oxygen is a scavenged gas.

8. The system of claim 1, wherein the first compartment and the second compartment are integral with the enclosure and separable therefrom by the fracturable wall.

9. The system of claim 1, wherein the indicating means is sensitive to carbon dioxide.

10. The system of claim 1, wherein the indicating means is selected to give a first visual indication when the proportion of oxygen in the enclosure is less than that of air and a second, different visual indication when the proportion of oxygen in the enclosure increases.

11. The system of claim 1, wherein the indicating means is sensitive to carbon dioxide.

12. The system of claim 1, wherein the indicating means is selected to give a first visual indication when the proportion of oxygen in the enclosure is less than that of air and a second, different visual indication when the proportion of oxygen in the enclosure increases.

13. A container characterized by a tamper evident system providing a visual indication of opening of the container, said container comprising (a) a body member defining an enclosure therein and having an opening into said enclosure, (b) a removable cap member closing said opening in said body member to provide a closed enclosure, said cap member including a see-through membrane therein, (c) a composition of gases in said closed enclosure that is changed upon removal of said cap member or other opening of said enclosure, indicating means located adjacent said see-through membrane and sensitive to a change in the composition of gases within said enclosure upon opening thereof for providing a visual indication that the composition of gases has changed and thus the enclosure has been opened, and (d) a fracturable membrane initially encapsulating said indicating means and being located in position to be fractured by said cap member when said cap member closes the enclosure to expose said indicating means to the enclosure and the composition of gases therein.

14. The system of claim 13, wherein the composition of the gas in the enclosure is different from that of air.

15. The system of claim 14, wherein the composition of the gas in the enclosure is provided by exposure to the indicating means, which scavenges one or more gases in the enclosure.

16. The system of claim 14, wherein the composition of the gas in the enclosure is provided by reacting reactive components one with another.

17. The system of claim 14, wherein the composition of the gas in the enclosure is provided by addition of a gas before the enclosure is closed.

18. The system of claim 17, wherein the gas which is added is carbon dioxide.

19. The system of claim 15, wherein oxygen is a scavenged gas.

* * * * *